US010654046B2

(12) United States Patent
Moran et al.

(10) Patent No.: US 10,654,046 B2
(45) Date of Patent: May 19, 2020

(54) SAND TREATMENT SYSTEMS AND METHODS

(71) Applicants: Murray J. Moran, Biloxi, MS (US); Murray L. Moran, Biloxi, MS (US)

(72) Inventors: Murray J. Moran, Biloxi, MS (US); Murray L. Moran, Biloxi, MS (US)

( * ) Notice: Subject to any disclaimer, the term of this patent is extended or adjusted under 35 U.S.C. 154(b) by 6 days.

(21) Appl. No.: 15/998,112

(22) Filed: Jul. 2, 2018

(65) Prior Publication Data

US 2019/0351428 A1 Nov. 21, 2019

Related U.S. Application Data

(62) Division of application No. 15/530,339, filed on Dec. 24, 2016, now Pat. No. 10,016,763.

(51) Int. Cl.

| | |
|---|---|
| ***B03B 7/00*** | (2006.01) |
| ***B03B 9/00*** | (2006.01) |
| ***B03B 11/00*** | (2006.01) |
| ***B03B 5/68*** | (2006.01) |
| ***B24B 31/10*** | (2006.01) |
| ***B07B 15/00*** | (2006.01) |
| ***B03B 5/70*** | (2006.01) |

(52) U.S. Cl.

CPC ..... *B03B 7/00* (2013.01); *B03B 5/68* (2013.01); *B03B 5/70* (2013.01); *B03B 9/00* (2013.01); *B03B 11/00* (2013.01); *B07B 15/00* (2013.01); *B24B 31/10* (2013.01); *B07B 2230/01* (2013.01)

(58) Field of Classification Search

CPC B03B 5/68; B03B 707/00; B03B 9/00; B03B 11/00; B07B 15/00; B24B 31/10

USPC ..... 209/17

See application file for complete search history.

(56) References Cited

U.S. PATENT DOCUMENTS

| | | | | |
|---|---|---|---|---|
| 1,410,340 | A | 3/1922 | Merwin | B03B 5/60 209/156 |
| 1,919,653 | A | 7/1933 | Hill | |
| 2,050,458 | A | 8/1936 | Ovestrud | B02C 21/02 209/17 |
| 3,071,900 | A | 1/1963 | Balz | |
| 3,871,438 | A | 3/1975 | Vissers | B22C 5/085 164/5 |
| 4,207,176 | A | 6/1980 | Hood | B03B 5/56 209/44 |
| 4,265,408 | A | 5/1981 | Voelskow | |
| 4,267,980 | A | 5/1981 | LaPoint | B03B 5/42 209/17 |
| 5,193,752 | A | 3/1993 | Yukimi | B02C 17/00 241/21 |
| 5,267,603 | A | 12/1993 | Didion | B22D 31/007 164/404 |
| 5,312,051 | A | 5/1994 | Preisser | |
| 5,471,692 | A | 12/1995 | Wasinger | |
| 5,595,349 | A | 1/1997 | Bergstrom | |
| 5,614,094 | A | 3/1997 | Deister et al. | |
| 5,638,887 | A | 6/1997 | Didion | B02C 17/22 164/269 |
| 5,921,401 | A | 7/1999 | Johnston | |
| 6,079,568 | A | 6/2000 | Loshe | |
| 6,156,083 | A | 12/2000 | Dial | |
| 6,238,516 | B1 | 5/2001 | Watson | |

(Continued)

*Primary Examiner* — Terrell H Matthews

(74) *Attorney, Agent, or Firm* — Guy McClung

(57) ABSTRACT

Systems and methods for treating aggregated material to separate out components thereof, using jetted water and/or screening apparatus, particularly to recover sand reusable in a fracking operation.

9 Claims, 9 Drawing Sheets

(56) References Cited

U.S. PATENT DOCUMENTS

| | | | | |
|---|---|---|---|---|
| 6,315,837 | B1 | 11/2001 | Barclay | |
| 6,367,134 | B1 | 4/2002 | Sanada | |
| 6,508,699 | B1 | 1/2003 | Santoriello | |
| 6,561,359 | B2 | 5/2003 | Egge | B03B 5/40 209/12.1 |
| 6,568,410 | B1 | 5/2003 | Teruggi | |
| 6,821,060 | B2 | 11/2004 | McTurk et al. | |
| 7,497,337 | B2 | 3/2009 | Tse | |
| 7,938,272 | B2 | 5/2011 | Anila | |
| 8,317,904 | B2 | 11/2012 | Sarshar | |
| 8,544,782 | B2 | 10/2013 | Musschoot | B02C 17/22 241/181 |
| 8,636,149 | B2 | 1/2014 | Craig | B03B 5/623 209/159 |
| 8,789,780 | B2 | 7/2014 | Brosseuk | B03B 5/26 241/74 |
| 8,910,796 | B2 | 12/2014 | Wojciechowski | B07B 1/485 209/274 |
| 2011/0100068 | A1 | 5/2011 | Simsek | |
| 2016/0263584 | A1 | 9/2016 | Moran | B24B 31/10 |

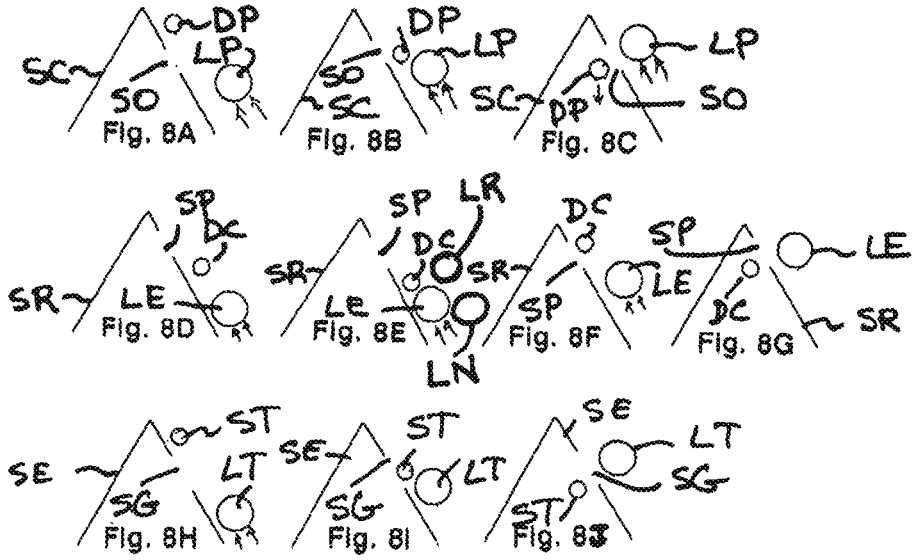
SC
DP
LP
SO
Fig. 8A
SO
SC
DP
LP
Fig. 8B
SC
DP
LP
SO
Fig. 8C
SR
SP
DC
LE
Fig. 8D
SR
SP
LR
DC
LE
LN
Fig. 8E
SR
DC
SP
Fig. 8F
SP
LE
LE
DC
Fig. 8G
SR
SE
ST
LT
SG
Fig. 8H
SE
ST
LT
SG
Fig. 8I
SE
LT
SG
ST
Fig. 8J
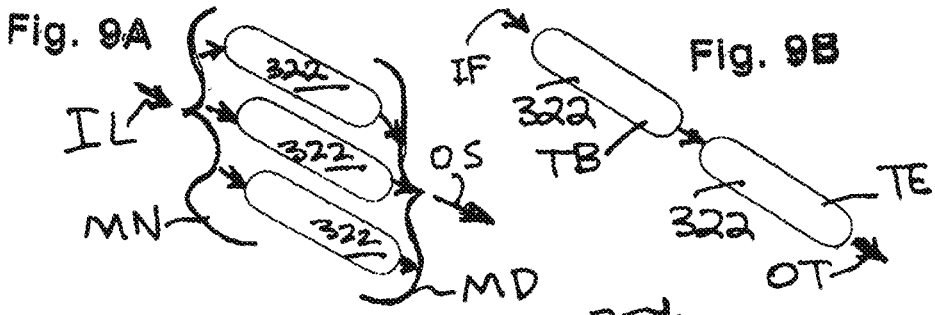
Fig. 9A
IL
322
322
322
MN
OS
MD
IF
Fig. 9B
322
TB
322
TE
OT
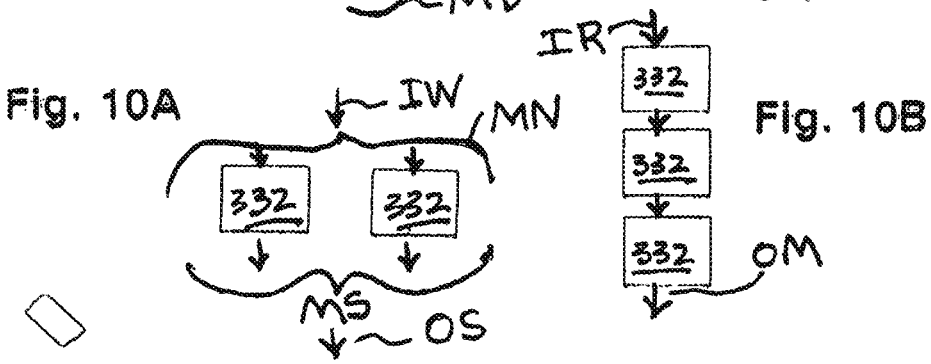
Fig. 10A
IW
MN
332
332
MS
OS
IR
332
332
332
OM
Fig. 10B
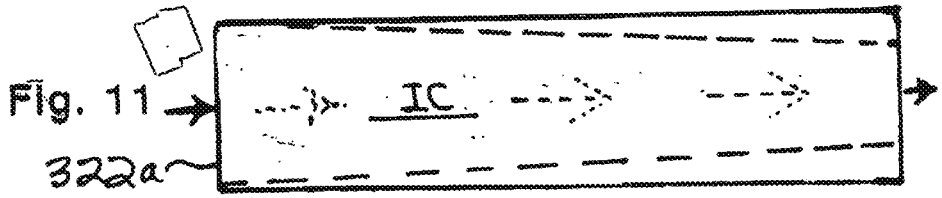
Fig. 11
IC
322a

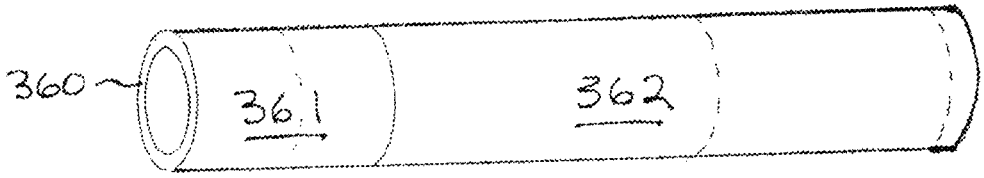
Fig. 14A
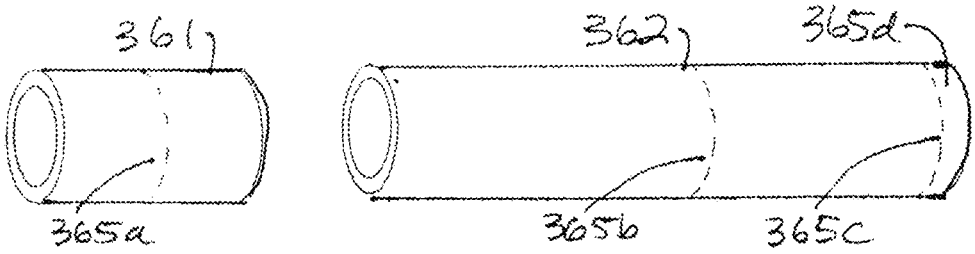
Fig. 14B
Fig. 15A
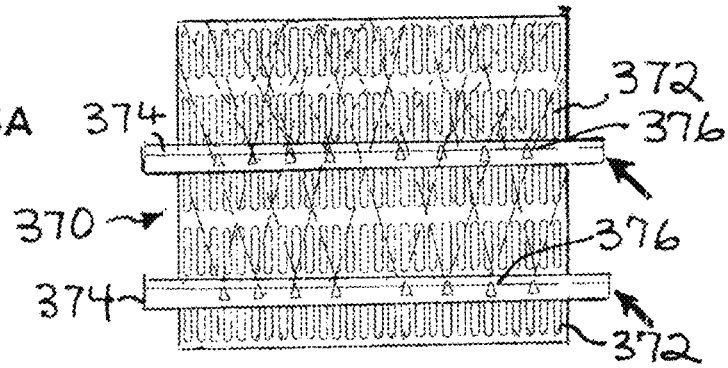
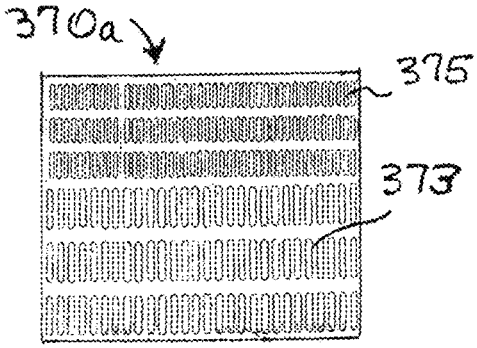
Fig. 15B
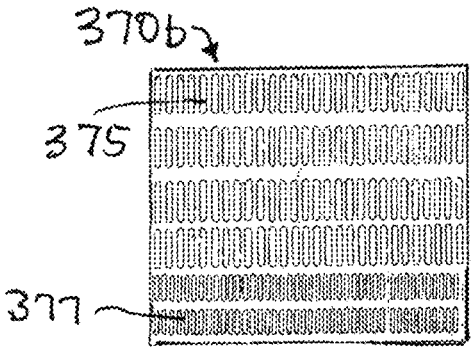
Fig. 15C

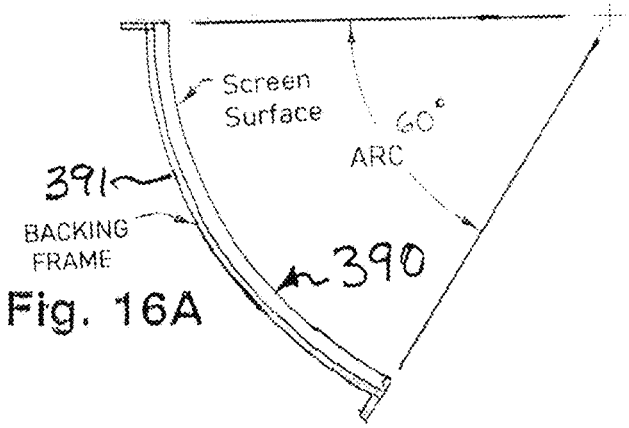
Fig. 16A
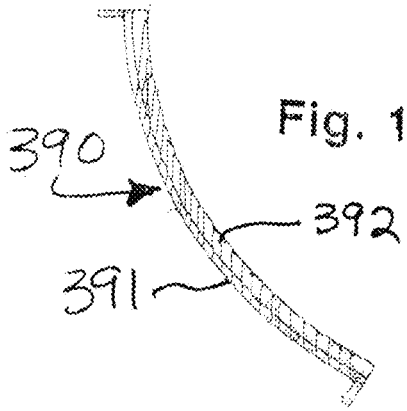
Fig. 16B
Fig. 16C
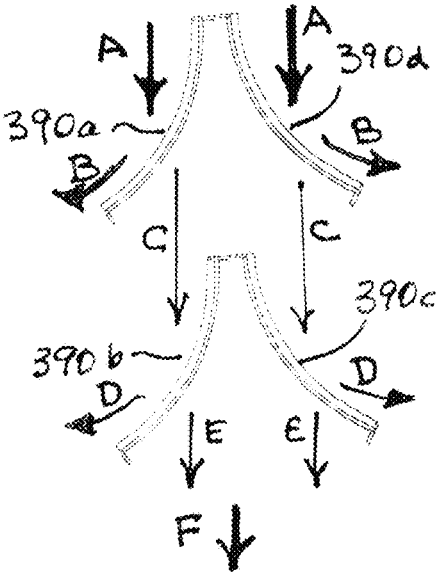
Fig. 17 PRIOR ART
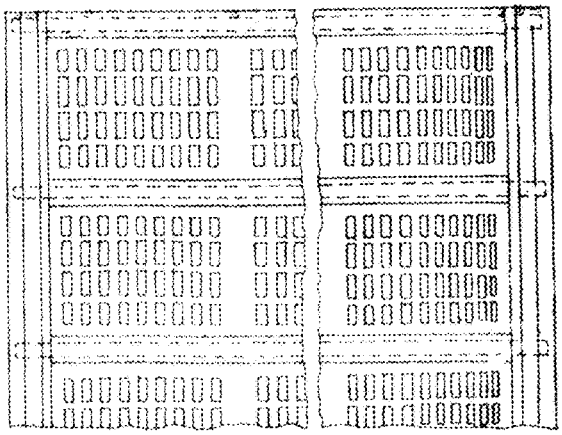
Fig. 18
PRIOR ART
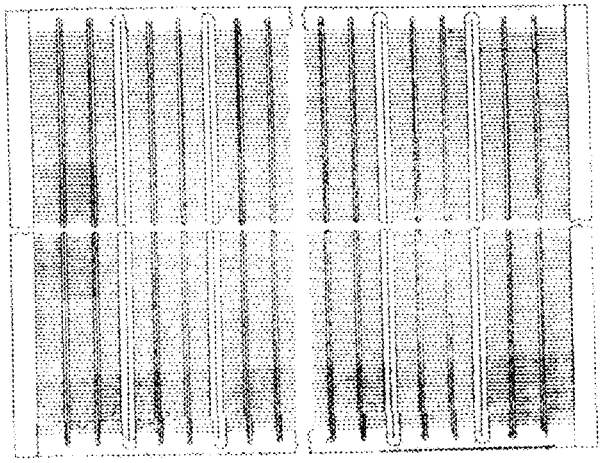

SAND TREATMENT SYSTEMS AND METHODS

RELATED APPLICATIONS

This is a division of U.S. application Ser. No. 15/530,339 filed Dec. 24, 2016 which is now issued patent U.S. Pat. No. 10,016,763 issued Jul. 10, 2018, which is a continuation-in-part of two Applications, U.S. application Ser. No. 14/645,884 filed Mar. 12, 2015, and U.S. application Ser. No. 14/645,895 filed Mar. 12, 2015. This invention and this application claim the benefits, including the benefit of the filing dates and of priority claim, of prior filed U.S. applications Ser. No. 15/530,339, filed Dec. 24, 2016, and Ser. Nos. 14/645,884 and 14/645,895, both filed Mar. 12, 2015, and all three applications and the issued patent incorporated fully herein for all purposes.

FIELD OF THE INVENTION

The present invention is directed to: treatment of aggregate particles; to processing of used aggregate particles and, e.g., to a device for treating used fracturing ("fraccing" or "fracking") sand to produce usable fracturing sand; to systems and methods for producing, from aggregate material, cleaned, separated and polished natural aggregates; to a processing of aggregate particles and, e.g., to a device for cleaning, separating and polishing of natural aggregate such as stone, sand, rocks, and gravel; to systems and methods for treating aggregate such as, e.g., gravel, sand, rocks, stones, and proppants, and in certain particular applications and embodiments, to treatment systems and methods directed to treating sand recovered from a wellbore which has been used in an earth fracturing operation.

BACKGROUND OF THE INVENTION

There are a wide variety of known aggregate and sand treatment systems and methods, including such for treating used fraccing sand.

Aggregates include granular materials, either naturally obtained or manufactured, and constitute an important component of infrastructure. Some natural aggregate resources are sand, gravel and crushed stone. Secondary aggregates include by products from industrial processes like blast, electric furnace slags or china clay residues. Development and extraction of natural aggregates can be significantly influenced by constraints such as urbanization, zonal regulations, increased costs and environmental concerns.

Natural aggregates include fragments, e.g. of stone, rock or sand, that are used in their natural state, or are used after mechanical processing such as crushing, washing, and sizing. Crushed stone and sand, and gravel are two sources of natural aggregate, which are used directly in construction or as a raw material for construction products such as concrete and bituminous road materials. Natural aggregate materials also serve as a major source for fracturing sand.

'Fracturing sand' or 'Frac sand' is typically a high-purity sand with very durable and round grains. They are of a specific size and are highly specialized for the oil industry. Primarily it is used in the hydraulic fracturing process known as "fracking" to assist in producing or extraction of petroleum fluids such as oil, natural gas and natural gas liquids from rock units that lack adequate pore space for these fluids to flow to a well. Based on the trend of increasing oil prices coupled with natural gas and oil exploration in the Western and Eastern United States, demand for frac sand had increased in the recent years. Methods for mining and preparing frac sand may vary slightly based on deposit location and quality of deposit.

Frac sand is often produced in a range of sizes from as small as 0.1 millimeter in diameter to over 2 millimeters in diameter depending on usage requirements. The characteristics of a high quality frac sand which can be used as a petroleum industry proppant include high-purity silica sand, standard grain size, spherical shape, turbidity, acid solubility and durability to resist crushing forces of closing fractures. Traditionally, the aggregate materials are processed into frac sand by running the cleaned aggregate particles across a large shaker screen of approximately 250 sq ft size, the shaker screens are operated using large electric motors, which resulted in space consumption and increased operation costs.

From the prior art, there exists numerous patents relating to aggregate and to frac sand processing apparatus and methods. For example: US patent publication no. 20140037962A shows an apparatus and a process for producing frac sand having a predetermined size range and sphericity from a feedstock material. US patent publication no. 20130233545 shows a manufacturing process of self-suspending proppants for hydraulic fracturing. U.S. Pat. No. 8,235,313 B2 discloses a method of making spherical proppant having a selected grade from naturally occurring, mined granular minerals. US patent publication no. 20140044967 shows a system for producing and processing an aggregate. US patent publication 20120068381 shows a mobile factory for stone making and concrete processing from natural aggregates. U.S. Pat. No. 7,380,674 discloses a method of processing and sorting aggregate material using a processing device. U.S. Pat. No. 2,146,405 shows an aggregate processing apparatus. However, certain existing aggregate processing devices also comprises limitations including infrastructure, apparatus size, operational complexity, inner plate wearing, complex machinery and the like; and certain existing frac sand processing or production devices comprises limitations including large screen size, operational complexity, high operational costs, complex machinery involving electric and/or mechanical parts, and the like.

Various processes for mining aggregate materials involve an old and known rough and abrasive process. Whether the reclamation of aggregate material is carried out via a dry mining process or a wet mining process, there still exists a need to separate dust, silt, clay or finely divided organic and inorganic material from the aggregate material. In addition, for certain applications, rounding or smoothing of the aggregate material edges is desired for providing aggregate material with uniform particulate size.

Accordingly, there exists needs for: effective and efficient systems and methods for treating aggregate materials, and, in there is a particular need for such systems and methods for treating used fraccing sand so that it is re-usable; a need for an improved device for efficient separation of aggregate material from dust, silt, clay and other unwanted materials and also polishing or smoothing the aggregate material surface to achieve a uniform particle size; and a need for an improved device and method for efficient processing of aggregate material into frac sand with uniform grain size, at high throughput.

SUMMARY OF THE INVENTION

The present invention, in certain aspects and embodiments, discloses a device for processing an aggregate material into fracturing sand, the device including, in certain embodiments: a screen box comprising an upper compartment adapted to receive an aggregate material from a hydro tube device; a plurality of induction jets connected to the steel box for supplying pressurized water, via spray nozzle heads, to wash the aggregate material through a series of grading screens. Such a device may further comprise a lower compartment to receive a washed aggregate from the upper compartment, and comprises a plurality of screen panels with a predefined size for screening out particles by washing down the particles of a predetermined size via a pipe to a sand screw for stacking a finished cut fracturing sand, and particles larger than the predetermined size are conveyed as waste to a hopper for disposal.

A device of the present invention, in certain aspects, improves the cut of the fracturing sand, without involving mechanical or electrical moving parts but utilizing the gravity of pressurized water and grading screens with predetermined mesh size for separation of particles according to different sizes from the aggregate material.

The present invention, in certain aspects, discloses a device for processing an aggregate material, the device, in certain embodiments, comprising: a gravity feed hopper to receive an aggregate material, e.g. but not limited to sand, and a conveyor tube with a proximal end adapted to receive the aggregate material from the hopper. The conveyor tube further connected to multiple induction jets to receive a supply of pressurized water from a water pump to form a slurry mix of aggregate material and a plurality of wear plates mounted on an inner surface of the conveyor tube, to allow the slurry mix to travel cylindrically around and down the tube towards a discharge outlet at a distal end of the conveyor tube.

In certain embodiments, the present invention discloses a device for processing an aggregate material into fracturing sand, the device comprising: a screen box comprising an upper compartment adapted to receive an aggregate material from a hydro tube device; a plurality of induction jets operatively connected to the screen box for supplying pressurized water, via spray nozzle heads, to wash the aggregate material through a series of grading screens; a lower compartment, adapted to receive a washed aggregate from the upper compartment, further comprises a plurality of screen panels with a predefined size for screening out particles of a predetermined size and convey to a sand screw adapted to receive a finished cut fracturing sand and washing down remaining particles to a hopper via a conveyor.

Such a device of the previous paragraph may have one, two, three, four, five or some of the following features and/or elements and/or aspects in any possible combination: wherein the aggregate material comprises stone, sand and gravel; a water manifold with a plurality of pressure gauges in fluid connection with the spray nozzle heads; wherein the plurality of induction jets are adapted to supply pressurized water at 55 psi pressure; wherein the plurality of induction jets are adapted to supply pressurized water at a rate of 500 gallons of water per minute; wherein the screen box and its compartments are gravity fed and comprise no mechanical moving parts; wherein the plurality of screen panels are set on an oblique angle of 60 degrees allowing gravity movement of the aggregate material with assistance of the water from spray nozzles; wherein the plurality of screen panels are located at a distal end of the device; wherein the plurality of screen panels are removable or replaceable, allowing fine tuning of the fracturing sand size; wherein the plurality of screen panels are selectable with pores of different shapes and sizes; wherein the plurality of screen panels comprises 64 square feet area; wherein the plurality of screen panels comprises 1.2 millimeter mesh size; wherein the aggregate material received from the hydro tube device comprises cleaned, separated and polished natural aggregate; and/or wherein the finished cut fracturing sand comprises a 20/70 fracturing sand.

The present invention, in certain aspects, discloses a device for processing an aggregate material, the device comprising: a) a conveyor tube with a proximal end adapted to receive an aggregate material from a hopper; b) a plurality of induction jets connected to the conveyor tube, to supply pressurized water received from a water pump to form a slurry mix of aggregate material; and c) a plurality of wear plates mounted on an inner surface of the conveyor tube, to allow the slurry mix to travel cylindrically around and down the conveyor tube towards a discharge outlet; and wherein the plurality of wear plates are overlapped with each other.

Such a device as in the previous paragraph may further include one, two, three, four or some of the following, in any possible combination: a water manifold comprising a plurality of pressure gauges in fluid connection with the induction jets; wherein the hopper comprises a gravity fed hopper; wherein the conveyor tube is at an oblique angle allowing gravity movement of the slurry mix through the conveyor tube; wherein the discharge outlet is present at the distal end of the conveyor tube; wherein the wear plates are removable and replaceable; wherein the conveyor tube is connected to a plurality of induction jets from above; wherein the conveyor tube is connected to a plurality of induction jets from below; and/or wherein the pressure gauges are connected to induction jets via water induction hoses.

Accordingly, the present invention includes features and advantages which are believed to advance aggregate treatment technology and frac sand treatment technology. Characteristics and advantages of the present invention described above and additional features and benefits will be readily apparent to those skilled in the art upon consideration of the following detailed description of preferred embodiments and referring to the accompanying drawings. What follows are some of, but not all, the objects of this invention. In addition to the specific objects stated below for at least certain embodiments of the invention, there are other objects and purposes which will be readily apparent to one of skill in this art who has the benefit of this invention's creative and inventive teachings and disclosures.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated.

There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention.

The claims of this invention are to be read to include any legally equivalent devices or methods which do not depart from the spirit and scope of the present invention. The present invention and its diverse embodiments recognize and address the long-felt needs and provides a solution to problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

It will be understood that the various embodiments of the present invention may include one, some, or any possible combination of the disclosed, described, and/or enumerated features, aspects, and/or improvements and/or technical advantages and/or elements in claims to this invention.

BRIEF DESCRIPTION OF THE DRAWINGS

The invention may be understood by reference to the following description taken in conjunction with the accompanying drawings, in which, like reference numerals identify like elements. These drawings illustrate certain embodiments of the present invention and are not to be used to improperly limit the scope of the invention which may have other equally effective or legally equivalent embodiments. In the appended figures, similar components and/or features may have the same numerical reference label. Various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

FIG. 8A is a schematic view of a system according to the present invention.

FIG. 8B is a schematic view of a system according to the present invention.

FIG. 8C is a schematic view of a system according to the present invention.

FIG. 8D is a schematic view of a system according to the present invention.

FIG. 8E is a schematic view of a system according to the present invention.

FIG. 8F is a schematic view of a system according to the present invention.

FIG. 8G is a schematic view of a system according to the present invention.

FIG. 8H is a schematic view of a system according to the present invention.

FIG. 8I is a schematic view of a system according to the present invention.

FIG. 8J is a schematic view of a system according to the present invention.

FIG. 9A is a schematic view of a combination of treating tubes according to the present invention.

FIG. 9B is a schematic view of a combination of treating tubes according to the present invention.

FIG. 10A is a schematic view of a combination of screening apparatus according to the present invention FIG. 10B is a schematic view of a combination of screening apparatus according to the present invention.

FIG. 11 is a top view of a treating tube for a system according to the present invention.

FIG. 14A is a side view of a treating tube for a system according to the present invention.

FIG. 14B is a side view of parts of the liner of FIG. 14A according to the present invention.

FIG. 15A is a side view of a screen with sprayers according to the present invention (top of the screen in use as the top as shown in the figure).

FIG. 15B is a top view of a screen with sprayers according to the present invention (top of the screen in use as the top as shown in the figure).

FIG. 15C is a top view of a screen with sprayers according to the present invention (top of the screen in use as the top as shown in the figure).

FIG. 16A is a side view of a concave screen for use with systems of the present invention.

FIG. 16B is a crosssection view of the screen of FIG. 16A showing openings through the screen from a top surface to a bottom surface thereof.

FIG. 16C shows an arrangement of four screens like those of FIG. 16A in a screen apparatus according to the present invention, with two screens above two screens.

FIG. 17 is a top view showing a prior art screen usable in some systems according to the present invention.

FIG. 18 is a top view showing a prior art screen usable in some systems according to the present invention.

DETAILED DESCRIPTION OF CERTAIN EMBODIMENTS OF THE INVENTION

Figure 1:
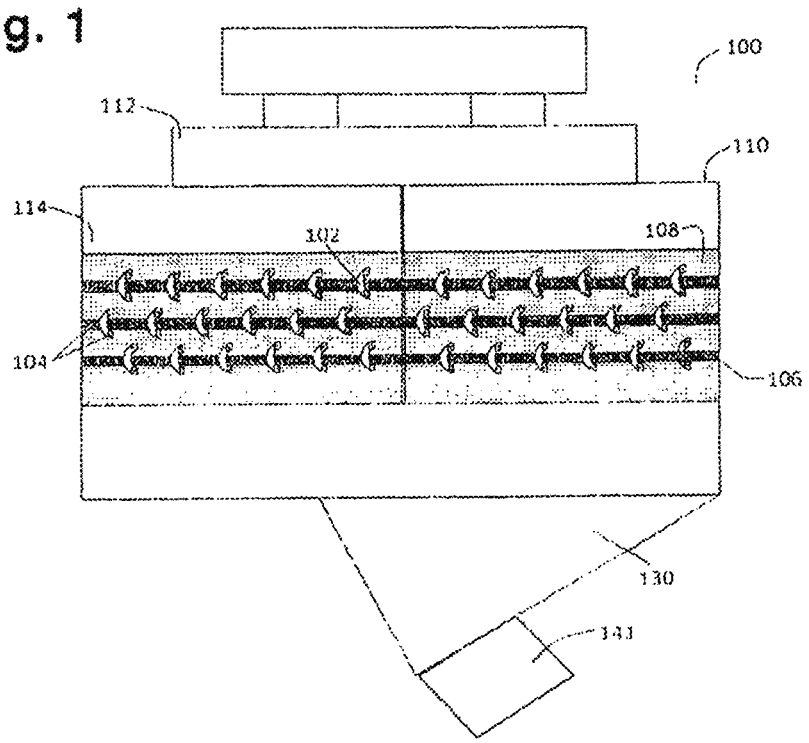
FIG. 1 is a front view of the device for processing an aggregate material into fracturing sand, according to an embodiment of the invention.

Referring to FIG. 1, which shows a front view of the device for processing an aggregate material into fracturing sand, the device 100 comprising: a screen box 110 comprising an upper compartment 112 adapted to receive an aggregate material from a hydro tube device (not shown). A plurality of induction jets 102 distributed over a water manifold 106, operatively connected to the screen box 110 for supplying pressurized water, via spray nozzle heads 104, to wash the aggregate material through a series of grading screens. The device 100 further comprises a lower compartment 114, adapted to receive a washed aggregate from the upper compartment 112, wherein the lower compartment 114 comprises a plurality of screen panels 108 with a predefined size for screening out particles larger than a predetermined size to a conveyor 130. The screen panels 108 washes down particles equal to or smaller than the predetermined size to a sand screw (not shown) via a 12 inch pipe (not shown) for stacking of finished cut fracturing sand, whereas aggregate materials larger than predetermined size are received at a hopper 141 via the conveyor 130 and disposed as a waste.

The screen panels 108 comprises a plurality of grading screens which are set on an oblique angle, preferably around 60 degrees, thereby allowing gravity movement of the aggregate material with assistance of the water from spray nozzles. In an embodiment, the plurality of screen panels are located at a distal end of the device and are replaceable with grading screens with desired mesh size.

The water manifold 106 is adapted to receive pressurized water from a water pump through a plurality of induction hoses. The pressure of the supplied water can be controlled by a pressure gauge. In general, natural aggregate material comprises of stone, sand and gravel. In an embodiment, the aggregate material received from the hydro tube device cleaned, separated and polished aggregate.

Further, the screen panels are selectable with pores of different shapes and sizes which enables fine tuning of the required fracturing sand size. In an embodiment, the screen panels comprises preferable size of about 64 square feet area and a mesh size of 1.2 millimeter. However, the mesh size differs according to the preferred cut of finished fracturing sand.

Figure 2:
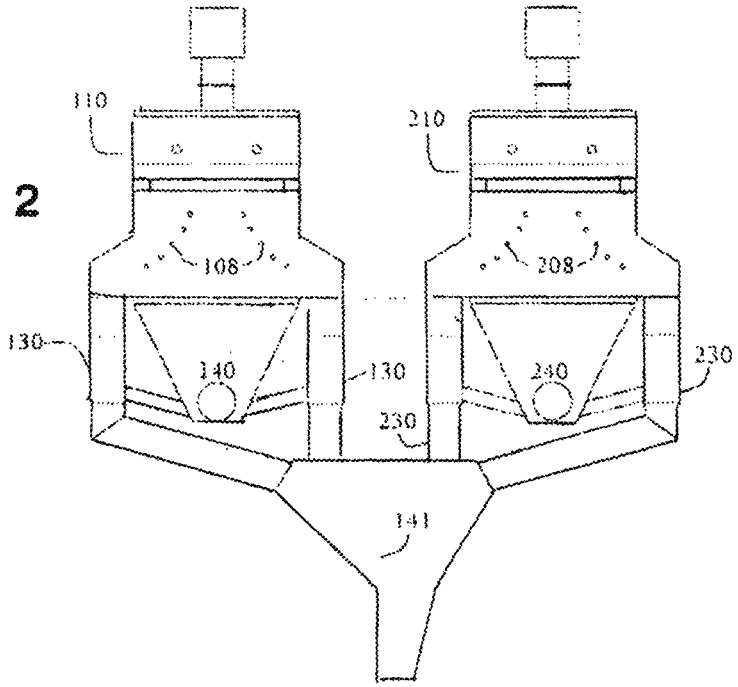
FIG. 2 is a side view of the device for processing an aggregate material into fracturing sand, comprising two units in combination, according to an embodiment of the invention.

FIG. 2 illustrates a side view of the device comprising two screen boxes in combination, for processing an aggregate material into fracturing sand, according to a different embodiment. The device comprises a first screen box 110 and a second screen box 210 connected together in operation. Each of the screen box 110 and 210 comprises upper and lower compartment with grading screens or screen panels 108, 208 respectively for separating particles according to a predetermined size, which are passed through a 12 inch pipe 140, 240 below the grading screens 108, 208 to a sand screw for stacking of a finished product, for example 30/70 cut fracturing sand. On the other hand, aggregate particles larger than the predetermined size such as pebbles are passed through conveyors 130 and 230 respectively to a hopper 141, configured to collect the waste.

The screen box further comprises a water manifold adapted to supply pressurized water through induction jets for screening aggregate particles based on size, for example: a predetermined size of and less than 1.2 millimeter is washed through the screens 108 into a bend/hopper and 12" pipe 140 which directs the finished frac sand to a sand screw to stack the finished frac sand.

In an embodiment, wherein the plurality of induction jets supplying pressurized water via induction jets attached to the water manifold is configured to supply water at a preferable pressure range around 55 psi and at a rate of 500 gallons of water per minute.

The device of the present invention can be constructed with any suitable material. By way of non-limiting example, the parts of the device can be manufactured using a variety of standard steel alloys which are able to withstand stress and dynamic load associated with the present invention. The water pump and water induction hoses can be selected based on the desired volume and pressure of water to be introduced into the manifold. Similarly, the pressure gauges can be selected based on the hydraulic pressure deployed through the water manifold and induction hoses.

Advantages of the device of present invention include, but are not limited to, usage of screen panels of only 64 sq. ft. in size for separating aggregate particles, whereas some traditional screening involves a large shaker screen of 250 sq. ft. Another advantage of the device of present invention includes absence of mechanical or electrical moving parts, instead the current device utilizes the gravity of pressurized water for grading and separation of aggregate material.

In an exemplary embodiment, the device is capable of removing 95% of other materials and exhibits cost effectiveness due to high productivity. For example, the device in one aspect produces 140 tons of 20/70 cut sand per hour. The merits of the current device may also decrease the cost of the end product, fracturing sand.

Referring to FIG. 1, which shows a side view of the device for aggregate material processing, the device comprises a gravity feed hopper 1 for receiving an aggregate material and a conveyor tube 2, with its proximal end connected to the outlet of the hopper 1 and distal end comprising a discharge outlet 10. The conveyor tube 2 further comprises a plurality of induction jets 3 configured to supply pressurized water received from a water pump 9 and a plurality of wear plates 5 mounted onto the inner surface of the conveyor tube 2. The device further comprises a water manifold 7 connected to the water pump via a manifold elbow 6. The water manifold consists a plurality of pressure gauges 11, in fluid connection with the induction jets 3 via water induction hoses 12.

The device can be mounted firmly on a stand comprising a plurality of legs 4 and a base support 8 connecting at least two legs 4 parallel to each other. In an embodiment, the induction jets 3 are serially distributed from below the conveyor tube 2 in order to supply pressurized stream of water into the conveyor tube 2 to form a slurry mixture of water and aggregate material. The wear plates 5 can be removable attached to the inner surface of the conveyor tube and can be replaced whenever needed.

FIG. 2 shows a side view of the device for aggregate material processing as described above. In an embodiment, the figure depicts that the induction jets 3 are serially distributed from above the conveyor tube 2 in order to supply pressurized stream of water into the conveyor tube 2 to form a slurry mixture of water and aggregate material.

Figure 3:
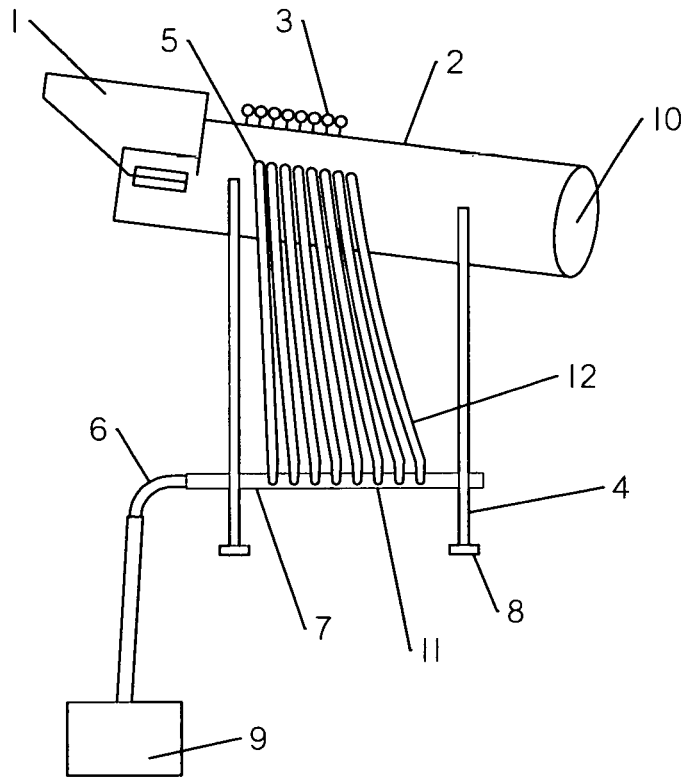
FIG. 3 is a side view of a device for processing a natural aggregate material with a conveyor tube connected to multiple induction jets from below, according to an embodiment of the invention.

FIG. 3 is a cut away view of the device for aggregate material processing. The figure, illustrates the arrangement of wear plates 5 according to an embodiment of the invention. The water induction hoses 12 are configured to deliver water to the induction jets 3, at a preset volume and pressure, in order to mix the aggregate material and water into a slurry 13, the mixture is moved cylindrically within the tube due to water pressure and moved further down the tube due to gravity and processed aggregate is discharged via the outlet at the distal end of the conveyor tube.

The wear plates 5 may further comprise channels which connect the induction jets 3 to inner area of conveyor tube 2. The wear plates 5 may also be configured to fit together in an overlapped fashion forming a smooth surface for the slurry mix to travel around, which leads to polishing or smoothing of the surface texture resulting in processed aggregate with uniform particle size or desired particle size.

Figure 4:
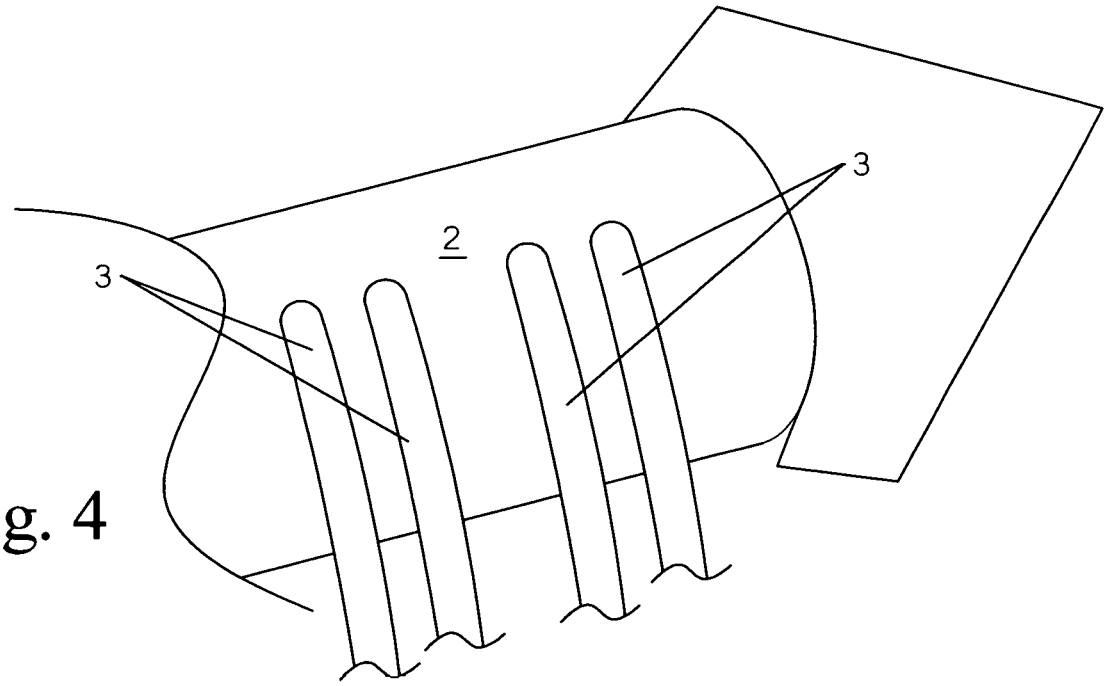
FIG. 4 is a side view of a device for processing a natural aggregate material with the conveyor tube connected to multiple induction jets from above, according to an embodiment of the invention.

In an embodiment, the wear plates are mounted onto the inner surface of the conveyor tube via a bolting or a similar means of attachment. FIG. 4 is a cross sectional view of the device showing wear plates mounted on the inner surface of the conveyor tube. In an embodiment, the wear plates 5 may comprise recessed cavities 15 to receive a bolt 16 which is driven through preformed holes or channels in the wear plate 5 connecting within the conveyor tube, and fastened with a fastener 17 on the external surface of the conveyor tube. Thus, the wear plates are securely attached to the inner circumference of the conveyor tube without the bolt's head structure interfering with the smoothness of tube inner surface.

The wear plate may also comprise a bolt mold or a counter bore to receive the bolt structure so as to form a smooth continuous surface on the inner circumference of the conveyor tube, thereby prevent wearing of the exposed bolt head.

Figure 5:
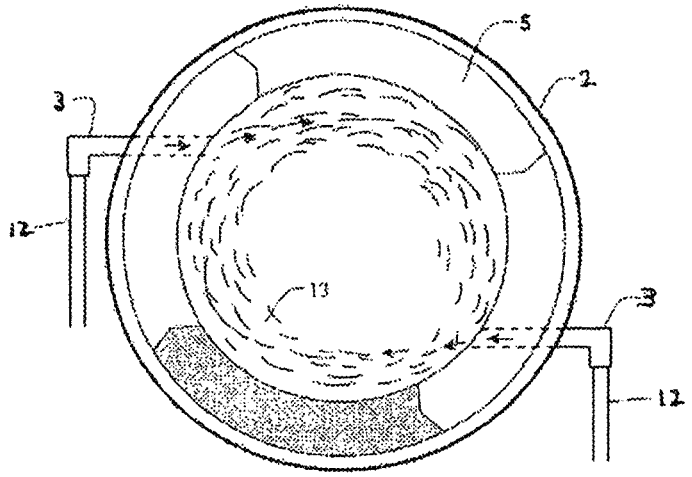
FIG. 5 is a cut away view of the device showing arrangement of wear plates.
Figure 6:
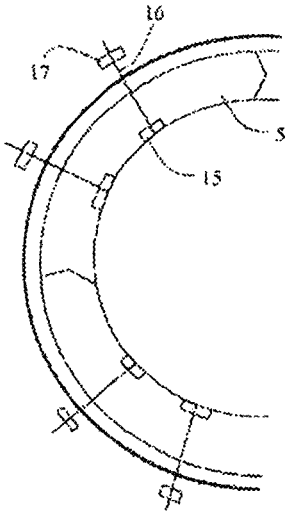
FIG. 6 is a sectional view of the device showing wear plates mounted to the conveyor tube.
Figure 7:
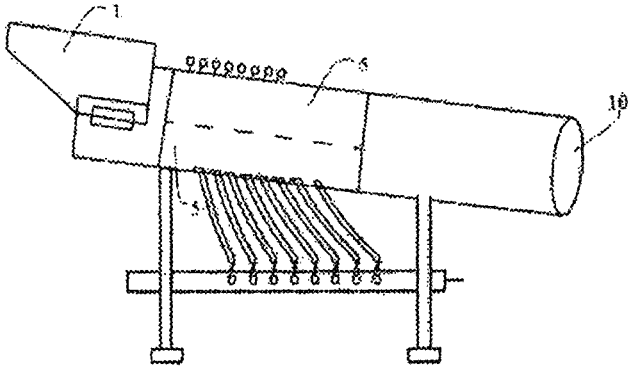
FIG. 7 is a side view of the device comprising removable wear plates according to an embodiment of the invention.

FIG. 5 shows a side view of the device comprising removable wear plates according to an embodiment of the invention. The removable wear plates 5 can be located on the inner surface of the conveyor tube adjacent to the proximal end, towards the hopper 1. In a different embodiment, the removable wear plates 5 can be located on the inner surface of the conveyor tube adjacent to the distal end, towards the outlet 10. The material, position and surface texture of the wear plate can be chosen according to the aggregate material to be processed.

In an exemplary embodiment, the aggregate material is introduced into the hopper and the aggregate is delivered to the conveyor tube via gravity. The aggregate is mixed with water at high pressure and volume, received via induction jet from the water pump, to create a slurry. The slurry of water and aggregate travel by tumbling cylindrically against the wear plates inside the conveyor tube and pass through the length of the tube to exit at the outlet due to gravity. The finish of processed aggregate material can be customized using the variables including alloy material, thickness and travel length of the wear plates, slanting angle of the conveyor tube, volume and pressure of induction jets.

The device of the present invention can be constructed with any suitable material. By way of non-limiting example, the parts of the device can be manufactured using a variety of standard steel alloys which are able to withstand stress and dynamic load associated with the present invention. The water pump and water induction hoses can be selected based on the desired volume and pressure of water to be introduced into the conveyor tube. Similarly, the pressure gauges can be selected based on the hydraulic pressure deployed through the water manifold and induction hoses. The wear plates can be constructed from a material that allows for surface molding of wear plates to create a riffling or tumbling effect on the slurry mix.

Advantages of the present invention include, but are not limited to, polishing or smoothing a variety of different aggregate materials in a larger volume and separation of clay, dust and silt from the targeted aggregate material.

Figure 8:
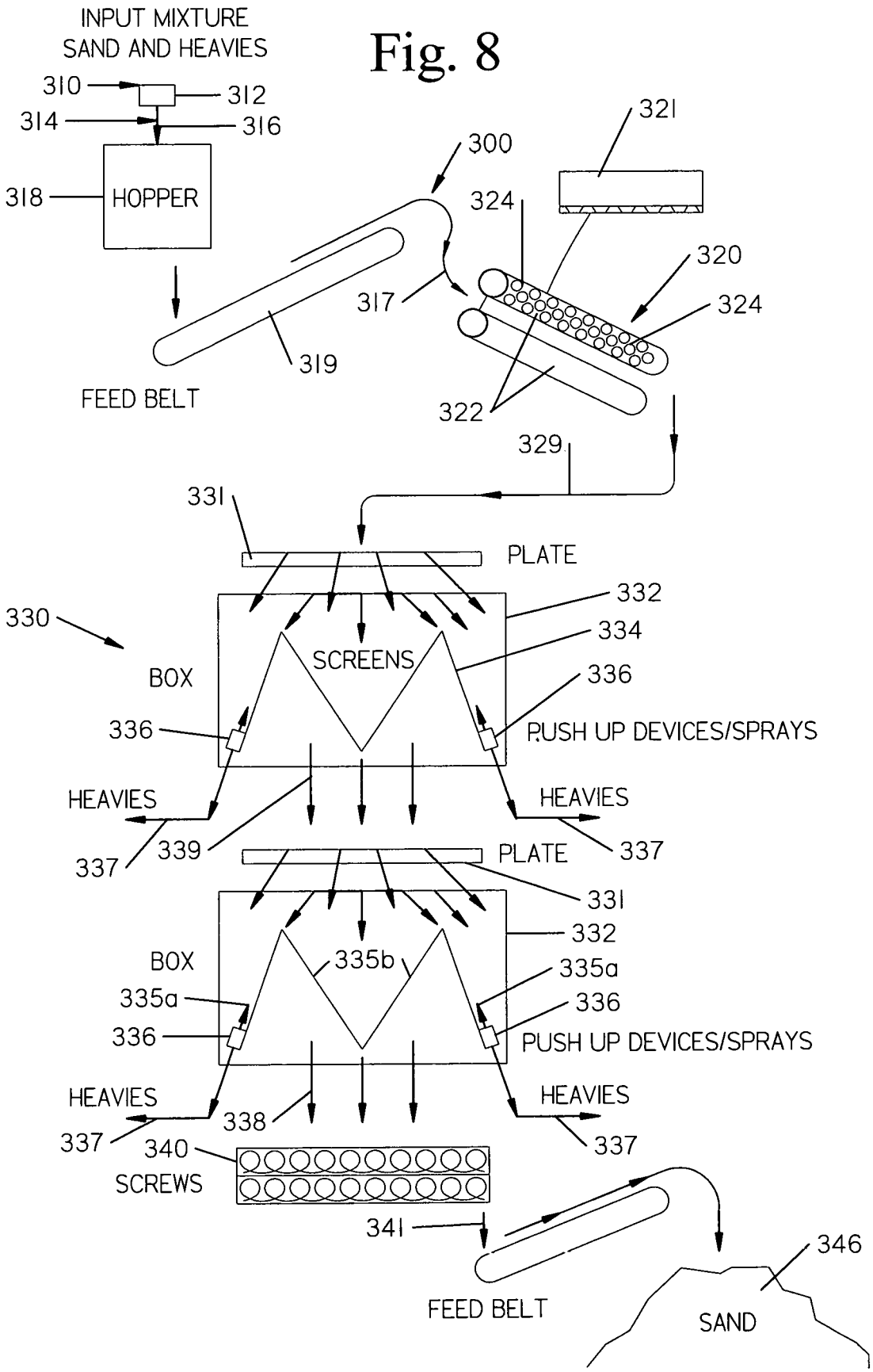
FIG. 8 is a schematic view of a system according to the present invention.

FIG. 8 shows a system 300 according to the present invention. Such a system can be used to treat any aggregate mixture, slurry, or stream with solids disclosed herein, or referenced herein or mentioned in any patent cited herein. In one aspect, an input feed of fracking material, including sand, in a slurry with water is fed to an optional pretreatment apparatus 312 which removes large gravel and/or washes the input material with water to wash off or wash away (and/or kill) impurities such as, calcium, oxidated iron, acids, bacteria, microorganisms, microbes, sodium, and organic materials. This optional apparatus may be used to remove any other material such as, but not limited to wellbore cuttings and debris. For killing microorganisms and bacteria, a bacteriocide or other killing material can be added to the sprays (and/or to any water input or to any stream at any point in any system according to the present invention, including in or on screen boxes, funnels, screws, belts and plates).

To enhance particles, to smooth them, for polishing effects and/or cleaning and/or to increase sphericity of the final product, e.g. but not limited to sand, an enhancing material such as pea gravel may be added to the output of the apparatus 312 in a stream 314. In one particular embodiment, the material is input at about 450 tons per hour, with about 1200 gallons of water per minute, and about 40 tons per minute of pea gravel. Instead of the pea gravel any suitable small size particulate of suitable hardness, real or artificial, natural or synthetic, may be used; e.g., but not limited to rock gravel, glass beads, ceramic beads, composite beads, or plastic beads. The resulting stream 316 is put into a hopper 318 from which it flows to a feed belt 319 (horizontal, or as shown, inclined) which moves the material for introduction into a stream 317 into treatment tube (or tubes) 322 of a treatment subsystem 320. The tube(s) 322 (also called "cylinders") may be as any disclosed herein.

A plurality of jets 324 with fluid exit nozzles within the tube(s) 322, shown schematically by circles, provide water jetted under pressure pumped from a pump system 321. The jetted water facilitates the "working" of the particles, i.e. it: impacts the particulate material; moves the material cylindrically within the tube rather than down the tube, although water will flow down the tube by gravity carrying material; separates agglomerated particles; washes particles; forces particles to interact with each other and/or with pea gravel and/or with larger particles (e.g. in one aspect larger than sand desired to be recovered) in the input material and/or with interior conduit and equipment part surfaces, in some instances to smooth particle surfaces and/or to enhance particle shape, i.e. so that prominent, protruding, uneven, spiky, and/or jagged parts are smoothed, worn off or broken off to enhance particle surfaces and/or to increase their sphericity; helps maintain them within the tube for a desired time period; and provides some water flow for the jet-treated material to exit by gravity flow from the tube(s) in an exit stream 329.

The jetted water also impels the particles against the interior surfaces of the tube(s) 322 and, if present, against wear plates and/or interior surfaces to both break up agglomerations of particles and to polish, smooth, and enhance the shape of particles. Such action by the jetted water can improve particle shape, enhancing shape for easier pumping, enhancing shape so that negative wear and abrasion effects of particles on equipment and conduits through which they flow are decreased, and/or increase particle sphericity. Particles with enhanced shape—due to this or to any other action in any part of a system according to the present invention—create less drag for fluids passing over them than do the surfaces of the unenhanced particles.

Water jetted in the direction shown, e.g., in FIG. 5, (a direction opposite to the direction of flow of material on a screen surface) actually impedes downward movement of the particles and increases residence time of the particles in the tubes, increasing time for "working" of the particles within the tubes to enhance them.

The stream 329 is fed to a screening subsystem 330 which includes a screen apparatus 332 (BOX") (or apparatuses 332; two shown). The stream 329 is fed onto a plate 331 to spread the stream flow into the apparatus 332 and so that the stream is not focused on or delivered to a small area of screening material. The unfocused flow from the plate 331 flows down to screens 334. Water spray devices 336 spray water onto the top of the screens 334, to impact material flowing down on the top surface of the screens 334 ("PUSH UP DEVICES/SPRAYS"). Sand to be recovered flows through the screens 334 and exits the apparatus 332 in an exit stream 339. Material that is screened out by the screens 334 flows off the tops of the screens in streams 337 (HEAVIES").

The devices 336 provide water under pressure to move solids back upward on the surfaces of the screens 334, to wash screen openings, and to enhance "working" of solids on the screens. These solids include some desirable sand that has not passed through the screens. By pushing this material back up on the screens 334, this sand has a chance to pass through the screens, although it did not previously do so. The devices 336, in addition to moving material, may also break agglomerations of material and cause pieces of material, including sand, to impact each other, improving their shape, enhancing their shape for easier pumping, enhancing their shape so that their negative effects on equipment and conduits through which they flow are decreased, and/or increasing their sphericity. The jetted water, in one aspect, is provided in sufficient amount and with a sufficient area of application that it assists in clearing the screen openings (in some cases, the majority of the screen openings and in some cases substantially all of the screen openings) and in maintaining them clear and open for the passage of sand therethrough; and/or in moving desired particles to and/or through the screen openings.

Any desired number of devices 336 may be used. Devices 336 may be on bars, supports, or tubes positioned adjacent the screens, with such bars etc. at various levels of the screens. In one aspect, sufficient devices 336 are used to provide sprayed water therefrom to the majority of or to substantially all of the surface of the screens 334; and/or to substantially all of the screen openings or to a majority of them. In other aspects, at least 80% or about 90% of the surfaces (and/or screen openings) are sprayed. Devices 336 may be provided for any surface of any screen used in any system of the present invention. The devices 336 may be in tiers or in or on different levels of the screens.

The screens 334 are at an angle from the vertical and their surfaces may be flat or they may be concave (see e.g., screens 335*a*, FIG. 8; or screens in FIG. 8A; and screens in FIGS. 16A and 16C). Four screen surfaces are shown for the screens 334 in FIG. 8; but it is within the scope of this invention to use any number of screens within a single enclosure of the apparatuses 332 and/or to have screen(s) at different heights within one single enclosure of an apparatus 332 (box), with sand flowing through an upper screen flowing down to a lower screen within a single box.

Material will be on the surface of a concave screen a relatively longer period of time than it will be on a similar flat screen, other things being equal. The combination of concave screens and sprayed water will maintain material on a screen surface relatively longer than it would be on a flat surface. The devices 336 may be used with flat screens or with concave screens.

In certain aspects, water from the devices 336 moves sand to and through openings of the screens and moves larger particles, like pea gravel and/or rocks or stones or debris or earth (that will not pass through the screen openings as do the sand particles) back up onto the screen where they can impact, contact, and or roll or move over sand particles, pushing the sand particles through the screen openings, facilitating their passage through the openings, and/or providing a momentary barrier at an opening preventing a sand particle from flowing down the top of the screen surface and enhancing its entry into an opening for passage through the screen. To accomplish this, the devices 336 are adjusted to that their sprays can move particles larger than the sand particles.

Material in the stream 339 flows down to another plate 331 from which it is spread into a lower apparatus 332, which is like the upper apparatus 332, and like numerals indicate like parts. The lower apparatus 332 has two concave screens 335*a*, 335*b*.

An exit stream 338, which is primarily made up of sand (e.g., in certain aspects, at least 90% sand by volume and in other aspects at least 96% sand by volume) flows from the lower apparatus 332 to a screw conveyor 340 ("SCREWS") which moves the material in a stream 341 to a feed belt conveyor 342 which moves the sand to a mass of re-usable sand 346. In one particular aspect, the sand 346 is about 2% to 3% water by weight, with the remainder sand.

It is within the scope of the present invention to use water sprayed onto the screens of a screening apparatus of a system according to the present invention (e.g. but not limited to screens 334, 335*a*, 335*b* and the screens in FIG. 2 and in FIG. 16) to move relatively larger particles upwardly to contact smaller particles that are to be recovered, smaller particles that are of such a size that they will pass through screen openings, while the larger particles are too large to pass through the openings. The sprayed water inhibits the passage of the larger particles off the top of the screening surface and makes it possible to use the larger particles, impelled by the jetted water, to: contact and/or impact a desirably-sized particle to facilitate its movement to a screen opening and its passage through the screen opening; to grind, polish and/or smooth the surface of a smaller particle; to move a smaller particle back up on a screen surface so that the smaller particle is moved adjacent a screen opening to increase the chance of the smaller particle going through the screen opening and/or to impact the smaller particle moving it to and/or through the screen opening; and/or the larger particle providing a barrier at or near a lower limit of a screen opening so that downward motion of the smaller particle is arrested adjacent the screen opening and its passage to and through the screen opening is facilitated. FIGS. 8A-8J illustrate some of these functions of pumping water onto or above a screen surface to capitalize on the motion and impact of the relatively larger particles.

FIG. 8A shows schematically a screen SC (which can be any screen of any screening apparatus according to the present invention, and, although shown as flat, can be a screen with a concave screen surface) with a screen opening SO large enough for a desirable particle DP (e.g. but not limited to a particle of recoverable sand) to pass through. Water jetted upwardly is moving a relatively larger particle LP upwardly. As shown in FIG. 8B, the particle LP has contacted the particle DP, inhibiting the further downward motion of the particle DP and moving it upwardly. As shown in FIG. 8C, the relatively larger particle DP has sufficiently moved the smaller particle that it has moved to and through the opening SO. The contact between the two particles can result in the enhancement of the shape of the particle DP (any enhancing described above).

FIG. 8D shows schematically a screen SR (which can be any screen of any screening apparatus according to the present invention, and, although shown as flat, can be a screen with a concave screen surface) with a screen opening SP large enough for a desirable particle DC (e.g. but not limited to a particle of recoverable sand) to pass through. As shown in FIG. 8D, the particle DC has passed the opening SP. Water sprayed upwardly is moving a relatively larger particle LE upwardly. As shown in FIG. 8E, the particle LE has contacted the particle DC and this contact, in some cases, (and/or the impulse of the water) results in the particle DC moving upwardly on the screen surface. As shown in FIG. 8F, the particle DC has been moved up above the level of the opening SP. The particle can now move to and through the opening SP. In one aspect, as shown in FIG. 8G, the particle LE assists in moving the particle DC through the opening SP (or another particle, either a larger particle or a smaller particle, not shown, can do this). The contact between the two particles can result in the enhancement of the shape of the particle DC (any enhancing described above), as is true for any two particles made to contact in any part of any system according to the present invention. Sprayed water alone in any system herein can move a desirable particle that has passed an opening back up to the opening.

As shown in FIG. 8E, it is possible for a plurality of particles (e.g. including particles labeled LE, LR, LN) acting adjacent each other and/or in unison to move a desirable particle or to form a barrier to movement of a desirable particle. Thus water and/or particles can increase the time a desirable particle is on a screen surface, thereby increasing the probability that a desirable particle will go through a screen opening and be recovered.

FIG. 8H shows a smaller particle ST approaching a point adjacent an opening SG of a screen SE according to the present invention (any screen disclosed herein). Water impelled against a relatively larger particle LT moves the particle LT upwardly on the screen surface to a point shown in FIG. 8I at which the particle LT blocks further downward motion of the particle ST with the particle ST at or near the opening SG. The particle ST can then move through the opening SG; and/or the particle LE can further move the particle ST to assist it in moving to and through the opening SG.

For any of the functions and effects described for the methods of FIGS. 8A-8J, (and for any system according to the present invention) the water for application onto a screen can be provided by any of the devices for water spraying or jetting disclosed herein, any of the devices 336, or by any suitable water provision apparatus, pumping system, jetting system, or device for supplying water under pressure.

FIG. 9A shows schematically a subsystem of tubes 322 in which a plurality of tubes are used in parallel. An input flow stream IL flows to a input manifold MN which provides a portion of the stream to each tube for processing of the material. An output stream from each tube flows to an output manifold MD which then provides an output stream OS. For such a plurality of tubes, any desired number of tubes may be used, e.g., two, three, four, etc.

FIG. 9B shows schematically a subsystem of tubes 322 in which a plurality of tubes are used in series. An input flow stream IF flows to a first tube TB and then the exit stream from the first tube flows to a second tube TE. The second tube produces an output stream OT. For such a plurality of tubes, any desired number of tubes may be used in series, e.g., two, three, four, etc.

FIG. 10A shows schematically a subsystem of screening apparatuses 332 (or "boxes') in which a plurality of apparatuses are used in parallel. An input flow stream IW flows to a input manifold MN which provides a portion of the stream to each screening apparatus for processing of the material. An output stream from each apparatus flows separately to further processing equipment or, as shown in FIG. 10A, flows to an output manifold MS which then provides an output stream OS. For such a plurality of tubes, any desired number of tubes may be used, e.g., two, three, four, etc.

FIG. 10B shows schematically a subsystem of apparatuses 332 in which a plurality of tubes are used in series. An input flow stream IR flows to a first apparatus 332 and its output stream flows to a second apparatus 332. The second apparatus 332 provides its output to a third apparatus 332 from which flows an output stream OM. For such a plurality of apparatuses 332, any desired number may be used, e.g., two, three, four, etc.

For enhancing particle shape as described above, it is within the scope of this invention to use as or on a surface to be impacted by particles flowing with respect to an item, any suitable material to enhance an impact or contact of particles against the surface. This includes using suitable hard or wear-resistant material to make the item, any material of suitable hardness, suitable abrasiveness, and/or wearability. It also includes covering, lining, or facing a surface with any desired material of suitable hardness and/or abrasion resistance and wearability.

FIG. 11 shows a tube 322*a*, like the tubes 322 described above, which has a lower bottom interior surface IC, indicated between the dotted lines in FIG. 11, which is either made of relatively hard material, e.g. but not limited to stainless steel, carbides, cermets, chromium and chromium alloys, or a nickel or nickel alloy of suitable hardness; or which is covered or hardfaced with suitable material, e.g. and suitable known hardfacing material including, but not limited to, carbides, nickel alloys, chromium alloys, and cermets. Dotted line arrows indicate the direction of material flow through the tube, from an input end (left side in FIG. 11) to an output end, with a wider larger area of hard material at the input end. It should be clear however that the entire surface of the interior of the tube can be covered, faced or lined with such material.

Figure 12:
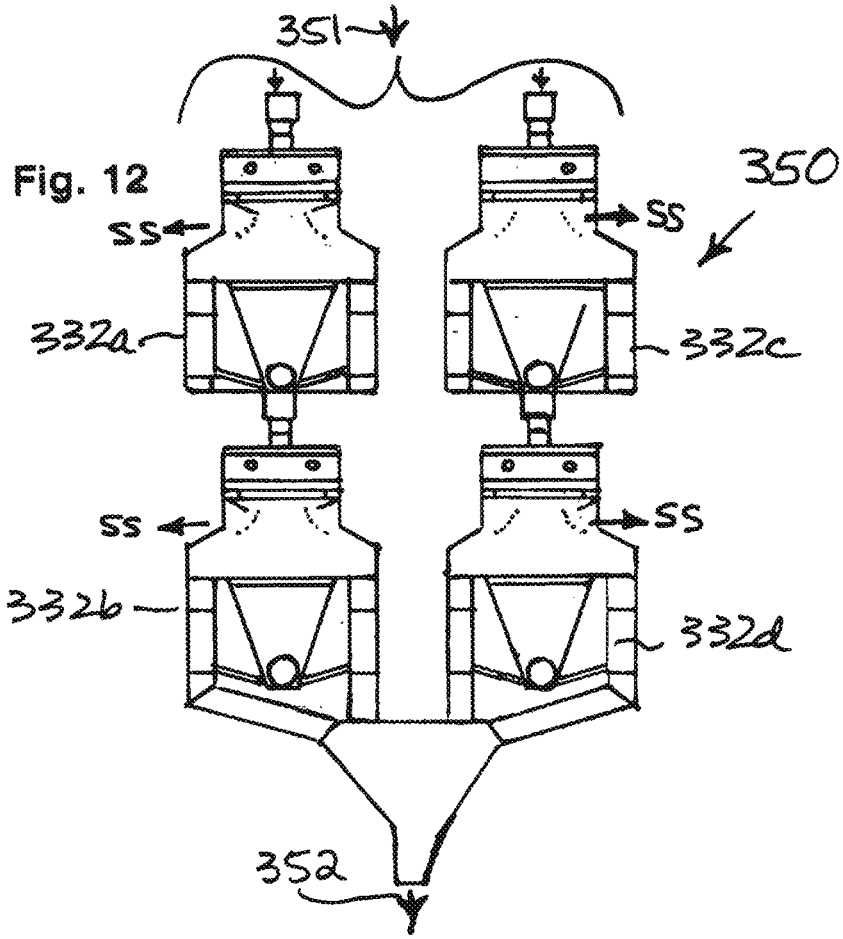
FIG. 12 is a schematic view of a screening apparatus according to the present invention.

FIG. 12 shows a screening subsystem 350 according to the present invention which has four screening apparatuses 332*a*-332*d* configured and disposed in a parallel/series arrangement for treating an input stream 351 of material which is divided for flows to each side (two screening apparatuses or boxes on each side) of the subsystem 350. Flows of processed material, e.g. but not limited to sand to be recovered, flowing through screens of the apparatuses 332*a*-332*d* from each side of the subsystem are then combined into one output stream 352, which is composed primarily of a desired recoverable material, e.g. sand. The apparatuses 332*a*-332*d* may be like any screening apparatus disclosed herein with flat and/or concave screens, with screened out material (which can be either waste to be disposed of, or itself a material desired to be recovered, as is true of any material coming off the top of any screen herein) in streams SS.

Processed material flowing through the screens of the apparatus 332*a* flows down and into the apparatus 332*b*. Processed material flowing through the screens of the apparatus 332*b* flows down to be part of the output stream 352. Processed material flowing through the screens of the apparatus 332*c* flows down and into the apparatus 332*d*. Processed material flowing through the screens of the apparatus 332*d* flows down to be part of the output stream 352. In one aspect, the amount of water flowing to the top box from the parts of the system before the top box is 2400 gallons per minute and also, therefore, 2400 flows to and then from the bottom box or boxes.

In one embodiment, there are a total of eight apparatuses 332, with four as those shown in FIG. 12 and another four, like the four shown, adjacent the apparatuses 332*a*-332*d*, with two pairs of series apparatuses—and with the output of all eight all eight contributing to the stream 352.

In one particular aspect, a system according to the present invention with screening apparatus as in FIG. 2 (with screens as in FIG. 16*a*) screened about 350 tons of sand an hour and produced a 20/70 frac sand mesh size cut (which has to be further processed to get usable 30/50 mesh size cut frac sand). In one particular aspect, a subsystem like the subsystem 350 of FIG. 12 (with screens as in FIG. 16C) produces 300 tons of frac sand an hour at a 30/50 mesh size cut. This sand, without further screening, is 100% usable as frac sand vs. the 20/70 cut sand of the FIG. 2 system that is only 65% usable sand. Thus using the system of FIG. 12, there is little or no production of waste sand (sand not in the desired size range) and there is less handling of non-usable material, reduced need to transport material to a drying facility, reduced wear on drying apparatus due to the finer sand; reduced wear on other equipment through which the sand may pass (e.g. but not limited to shaker screens); and less need to dispose of unusable sand. The reduction in or elimination of waste sand reduces handling such as loading/unloading into trucks hoppers, dryers and dry side screens, with corresponding reductions in labor, drivers, wear and tear on loaders, trucks, dryers and screens as well as fuel and electric power.

Figure 13A:
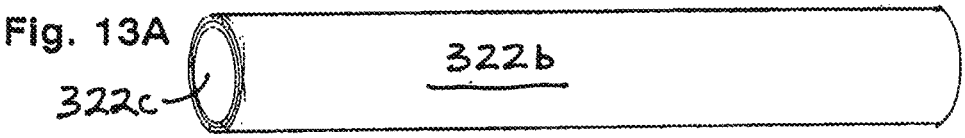
FIG. 13A is a side view of a treating tube for a system according to the present invention.

FIG. 13A shows a tube 322*b*, like the tubes 322*a* and 322 described above, with a liner 322*c*. The liner 322*c* can be insertable into and removable from the tube 322*b*. Optionally, the liner 322*c* may be permanently installed within the tube 322*b*, or it may be material applied to the interior of the tube 322*b*. The liner 322*c* may be made of any suitable hard material or wear-resistant material mentioned herein or it may be made from any known suitable conduit, pipe, or pipeline lining material, including, but not limited to, any suitable metal or metal alloy, elastomer, composite, fiberglass, epoxy resin material and PVC material.

It is within the scope of the present invention to line a tube, like any of the tubes 322 or any tube (also called "cylinder") according to the present invention with a multi-piece liner. The pieces can be of any desired length and made of any desired material, including, but not limited to, those already mentioned herein for lining, covering, or facing a surface or for making a liner.

FIGS. 14A and 14B show a hollow liner 360 according to the present invention which is tubular with tubular parts 361 and 362 designed and configured for use in a tube 322. In one aspect, the parts can be inserted into a tube and removed therefrom. In one aspect, the liner 360 is like the liner 322*c* of FIG. 13B.

Dotted lines 365*a* and 365*b* around the parts 361 and 362 indicate that the liner parts can be any desired length. Dotted line 365*c* indicates that at a liner exit end 365*d*, a length at the end of a liner or part of a liner can be treated with material or made of material like any of the lining or covering or facing material mentioned herein.

Figure 13B:
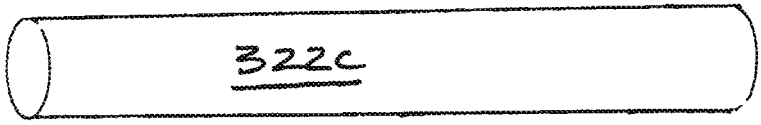
FIG. 13B is a side view of a liner of the treating tube of FIG. 13A for a system according to the present invention.
Figure 13C:
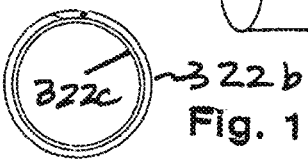
FIG. 13C is an end view of the treating tube of FIG. 13A.

In one aspect, the part 361 is intended for the material-introduction end of a tube where relatively more turbulence, abrasion and wear is expected and is made of relatively tougher material such as a hard metal or metal alloy, composite, carbide, carbide alloy, chromium alloy or nickel alloy. In such a case, the other part 362 may be made of a less tough material, e.g. but not limited to polyvinyl chloride ("PVC") material or some similar material. Optionally only the part 361 is used. Optionally, liners as in FIGS. 13B and 14A are used instead of any of the wear plates disclosed herein; or they are used in addition to such wear plates.

In one particular aspect, a screening apparatus according to the present invention has one, two, three, or more bars with water spray devices for jetting water at high pressure onto the material flowing on the surface of a screen and onto the screen surface. In one embodiment, water is sprayed from these devices so that substantially all the surface of the screen is sprayed and so that water under pressure is directed to each (or a majority of) screen opening through which particles of a desired size (e.g. sand of a desired cut) may pass. Each bar may have multiple sprayers, jets, or nozzles for spraying water into the flow of sand and onto the screens to facilitate the downward flow of sand, to move sand and material upward on the screen surface, to work the sand, and/or to enhance the passage of sand through the screen openings. Water under pressure supplied to these sprayers may be pumped at any desired pressure, e.g., but not limited to, at 45 psi or at 60 psi. "Work" includes facilitating particle-particle contact and interaction, and particle-to-surface interaction and contact.

It is within the scope of the present invention to use any known suitable screen or screen assembly for the screens of any embodiment of the present invention. The screens may be flat, 3D, or concave. When material with sand in it is being screened to collect sand that passes through the screens, any suitable known sand screen can be used, including, but not limited to, those disclosed in U.S. Pat. Nos. 4,819,809; 4,100,248; 8,783,349; 9,254,454; 5,088,554; 4,062,769; 4,222,865; 6,684,951; 9,403,192; 4,383,919; 3,483,974 and 4,100,248 (it being understood that any tubular screen in any of these patents will be used in flat or curved form for systems according to the present invention). It is within the scope of the prevent invention for a screen for use with an embodiment of the present invention to be made of any suitable material, including, but not limited to, metals, steel, rubber, stainless steel, composite, urethane, plastics, fiberglass, cermets, polyurethane and ceramics and/or combinations of these materials and/or any material for a screen mentioned in any patent cited herein; and similarly, if screen mesh, wire cloth, perforated plate, or wire mesh is used, it may be of any of these materials.

It is within the scope of the present invention to use holes, slots, or openings for a screen which are of any desired shape, configuration, largest dimension, diameter, size, width and length and to use any desired number of such holes, etc; and in one particular aspect to use openings as in FIG. 1 of U.S. Pat. No. 4,819,809 and/or to have about one thousand slots per thirty square centimeters of screen surface area. In certain aspects, the screen openings are slots or elongated holes that are: 2.0 mm wide and between 10 to 35 mm long; between 10 mm to 35 mm wide; 0.78 mm wide; about 1.5 mm wide and approximately 25 mm long; between 2 to 3 mm wide; or between 0.25 and 1.0 mm wide. The screens may be of any desired thickness, which will correspond to the depth or the length (through the screen) of the openings, slots, or holes.

FIG. 15A shows a screen 370 according to the present invention as it would be positioned in a screening apparatus as, e.g., in FIGS. 1,2, 8, 8A-8J, or 12. The screen 370 has a plurality of spaced-apart openings 372 across substantially all of its surface through which particles of a desired size pass, and through which particles of a desired size cannot pass. Two hollow bars 374 extend over the screen 370 each with a plurality of spaced-apart nozzles 376 (eight for each bar). Water pumped under pressure through nozzles (indicated by the triangles on each bar) is sprayed onto the screen surface to facilitate the flow of material down the screen, to push material back up the screen, to push material to the openings, to facilitate the entry of material into the openings, to clear the openings, to provide water to enhance material flow on and down the screen surface and flow through the screen, and to facilitate working of the particles (with each other and/or with the screen surface) and/or to facilitate the movement of relatively larger particles to move relatively smaller particles to and through the openings and through the openings.

As shown by the dotted lines in FIG. 15A associated with each nozzle, the bars may be located, the nozzles may be sized, the flow of water may be adjusted, and the sprays located so that substantially all of the screen surface is sprayed and/or so that each opening is sprayed. The openings 372 may be of different sizes, e.g. different widths or different lengths; or, as shown, they may all be of the same dimensions.

FIG. 15B shows a screen 370*a* like that of FIG. 15A with slots 371 at the top of the screen and larger slots 373 at the bottom.

FIG. 150 shows a screen 370*b* like that of FIG. 15A with slots 375 at the top of the screen and smaller slots 377 at the bottom. As desired, any screen of any of FIGS. 15A and 15B, or any screen herein, may be inverted so that the bottom slots are switched to a top of the screen, or screens can be made with slots of different size at any desired level of the screen.

FIGS. 16A and 16B show a screen 390 for use in screening apparatuses according to the present invention which has a base 391 and openings 392 (extending through the screen) across its surface (e.g. as in one of the screens of FIGS. 15A-15C or the screens of FIGS. 16A, 16D or 16I). The base 391 may be made of any suitable material, including, but not limited to, steel, urethane, stainless steel, plastic, polyurethane, and composite material. The openings 392 are sized and configured and positioned so that, as shown in FIG. 16B, the length of each of the openings is east-west, substantially horizontal in use; and some of them are taller, i.e. their length through the screen is longer, than others, the ones near the bottom (to the right in FIG. 16B) being shorter than the ones at the top. The openings 392 may be like any holes, slots, or openings described or disclosed herein, and in any pattern or arrangement described or disclosed herein.

A shown in FIG. 16A, the screen 390 is referred to as a "60 degree" screen with the 60 degree angle as indicated in FIG. 16A. A screen at this angle, or at any angle less than 90 degrees, is referred to herein as a "concave" screen; and it is within the scope of the present invention for such a screen to be flat (not concave) or to be at any desired angle.

FIG. 16C shows an arrangement of four screens 390*a*-390*d*, like the screen 390, with two upper screens above two lower screens (390*a* above 390*b*; 390*d* above 390*c*) in a box (not shown; e.g. like the apparatuses or boxes or enclosures of FIG. or of FIG. 12). Input material (arrows A) flows down and screened material of a larger size moves off the tops of the screens 390*a* and 390*d* (arrows B), and smaller dimensioned material flows down to the screens 390*b* and 390*c* (arrows C). Material of a larger size moves off the tops of the screens 390*b* and 390*c* (arrows D) and smaller dimensioned material flows down in streams (arrows E) to an output stream F (like the stream 352, FIG. 12).

Figure 19:
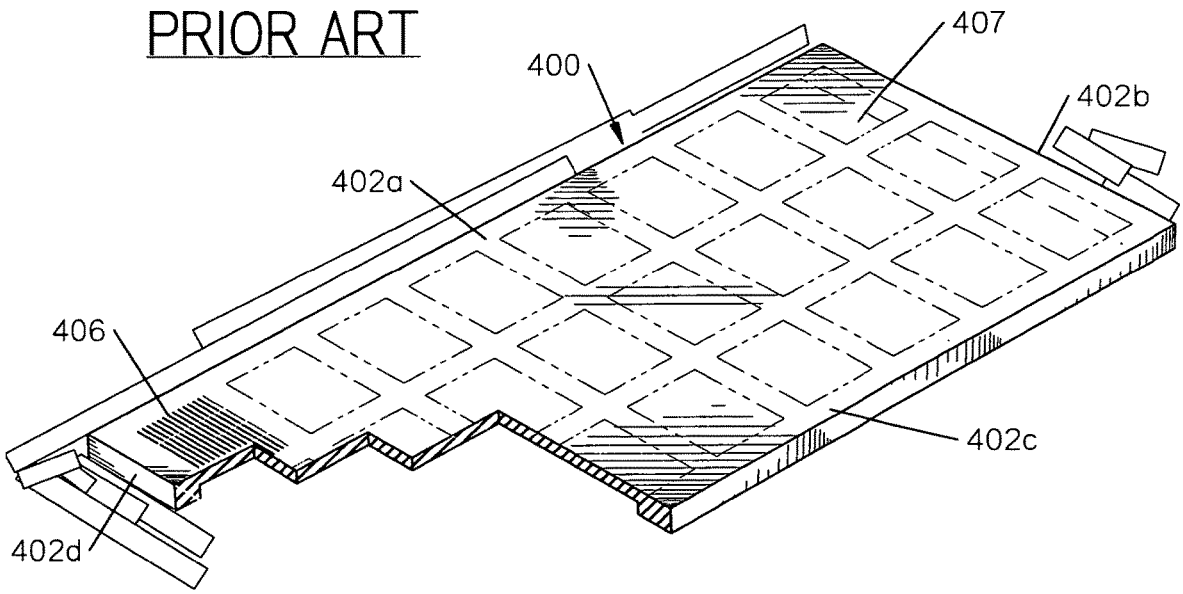
FIG. 19 is a top view showing a prior art screen usable in some systems according to the present invention.

In one embodiment, the screens of FIG. 16C are like the screen of FIG. 19 (but with fifty six of the areas 407, each with a plurality of openings 406 as shown in FIG. 19). It is within the scope of this invention to have as many or as few areas 407 with openings as desired.). In one aspect, the upper screens 390*a* and 390*d* have openings (like the openings 406) each of which has a size of 2 mm (largest dimension particle allowed through is smaller than 2 mm) and runs side to side on the screen (i.e. with the side 402*b* at the top with the screen mounted in a box); and the bottom screens have similar openings), but they have a size of 0.78 mm. In one such aspect, when the input material includes sand to be treated with pea gravel (as described above), relatively fine pea gravel and larger sand grains (along with smaller grains) flows in the streams labelled "C" down to the lower screens 390*b* and 390*c*. The lower screens, with their 0.78 mm openings prevent material larger than a 30/50 cut from passing through the screens, i.e. material larger than the 30/50 cut does not pass through the lower screens. This makes it possible to screen out some of the relatively larger particles with the lower screens; i.e. some of this load is taken off the upper screens and these particles are screened out by the lower screens.

It is within the scope of the present invention to use a screen like the screens disclosed in U.S. Pat. No. 4,383,919 (shown in FIG. 17) for a screen for a system according to the present invention (appropriately sized; with openings as shown or with any openings of any size in any pattern disclosed or referred to herein).

It is within the scope of the present invention to use a screen like the screens disclosed in U.S. Pat. No. 4,819,809 (shown in FIG. 18) for a screen for a system according to the present invention (appropriately sized; with openings as shown or with any openings of any size in any pattern disclosed or referred to herein).

It is within the scope of the present invention to use a screen like the screens disclosed in U.S. Pat. No. 4,222,865 (shown in FIG. 19) for a screen for a system according to the present invention, the screen appropriately sized for such a system (screen shown partially cutaway; with openings as shown or with any openings in any pattern disclosed or referred to herein). Such a screen 400 with sides 402*a*-402*d* has a large plurality of openings 406 arranged in a pattern (as shown in one corner of the screen in FIG. 19)—it being understood that such openings are across substantially all of the screen surface as shown. Each area 407, indicated by dotted lines on the screen surface, has openings as the indicated openings 406 in the same pattern. Such a screen, as desired, may have hundreds or thousands of such openings. Such a screen may be made from any desired material, including polyurethane and urethane. Either such a screen can be positioned in use with side 402*a* as the top side, or with side 402*b* as the top side.

In certain embodiments, screens as in FIGS. 15A-15C, each having an indicated plurality of elongated openings, may, instead of each of these openings, have a large plurality of openings like the openings 406 of FIG. 19. Such openings in these screen may extend lengthwise side-to-side ("east-west") or top-to-bottom ("north-south").

In one particular aspect, systems according to the present invention, e.g. a system as in FIG. 8 with screens as in FIG. 16, processes input sand (in one current aspect valued currently at about $2.50 per ton) to clean, polish, and smooth the sand to improve it to ISO grade commercial frac sand, valued currently at about $40.00 per ton. In such a system, the water pressure of water pumped into the tubes, like the tubes 322, is about 150 psi; and the residence time of material in the tubes is about ten seconds per ton. Sand rounded and/or smoothed by a system used according to a method according to the present invention which has had its sphericity increased also has a corresponding increase in its crush value; e.g., before processing some material with sand processed by a system according to the present invention had a crush value of 4.5 psi to 5.0 psi and after processing through the system had a crush value of 6.0k psi.

It is within the scope of the present invention to process any flowable aggregated material through a system according to the present invention; including, but not limited to, flowable material in streams with particles of different sizes, frac sand slurries, drilled cuttings slurries, any wellbore fluid or drilling fluid with solids therein, and lost circulation material streams.

As can be seen from the foregoing, the aspects, concepts and elements of the present invention may be embodied in a variety of ways. It involves both structures, method steps, and techniques as well as devices to accomplish the appropriate ends. Techniques and method steps according to the present invention are disclosed as part of the results shown to be achieved by the various devices and structures and described and as steps which for utilization of the devices and structures as intended and described. In addition, while some devices and structures are disclosed, it should be understood that these not only accomplish certain methods but also can be varied in a number of ways within the scope of the present invention. As to all of the foregoing, all of these facets should be understood as encompassed by this disclosure.

The discussion herein is intended to serve as a basic description. The specific discussion may not explicitly describe all embodiments possible; many alternatives are implicit and are within the scope of the present invention.

Where the invention is described in device-oriented or apparatus-oriented terminology, each element of the device or apparatus implicitly performs a function. Apparatus claims may not only be included for the device or apparatus described, but also method or process claims may be included to address the functions the invention and each element performs. Neither the description nor the terminology is intended to limit the scope of the claims that will be included in any subsequent patent application.

It should also be understood that a variety of changes may be made without departing from the scope of the invention. Such changes are also implicitly included in the description. They still fall within the scope of this invention. A broad disclosure encompassing both the explicit embodiment(s) shown, the great variety of implicit alternative embodiments, and the broad methods or processes within the scope of the invention, and the like, are encompassed by this disclosure and may be relied upon when drafting the claims for any subsequent patent application.

It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms-even if only the function or result is the same. Such equivalent, broader, or even more generic terms should be considered to be encompassed in the description of each element or action.

Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element effects or facilitates. Regarding this last aspect, as but one example, the disclosure of a "support" should be understood to encompass disclosure of the act of "supporting"—whether explicitly discussed or not—and, conversely, were there is effectively the disclosure of the act of "supporting", such a disclosure should be understood to encompass disclosure of a "support". Such changes and alternative terms are to be understood to be explicitly included in the description.

Any acts of law, statutes, regulations, or rules mentioned in this application for patent; or patents, publications, or other references mentioned in this application for patent are hereby incorporated fully and for all purposes by reference. In addition, as to each term used it should be understood that unless its utilization in this application is inconsistent with such interpretation, common dictionary definitions should be understood as incorporated for each term and all definitions, alternative terms, and synonyms are hereby incorporated by reference.

The inventors should be understood to have support to claim and make a statement of invention to at least: i) each of the systems and new parts thereof as herein disclosed and described, ii) the related methods disclosed and described, iii) similar, equivalent, and even implicit variations of each of these systems, parts, and methods, iv) those alternative designs which accomplish each of the functions shown as are disclosed and described, v) those alternative designs and methods which accomplish each of the functions shown as are implicit to accomplish that which is disclosed and described, vi) each aspect, feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying embodiments and examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the inventors may at any time present only initial claims or perhaps only initial claims with only initial dependencies, to systems only, to methods only, or to both. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available.

To the extent that insubstantial substitutes are made, to the extent that the applicant did not in fact draft any claim so as to literally encompass any particular embodiment, and to the extent otherwise applicable, the applicant should not be understood to have in any way intended to or actually waived or relinquished such coverage.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. A reference to an element by the indefinite article "a" does not exclude the possibility that more than one of the element is present, unless the context clearly requires that there be one and only one of the elements.

Any claims set forth at any time during the pendency of the application for this patent or offspring of it are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Certain changes can be made in the subject matter without departing from the spirit and the scope of this invention. It is realized that changes are possible within the scope of this invention and it is further intended that each element or step recited herein is to be understood as referring to the step literally and/or to all equivalent elements or steps. It is intended to cover the invention as broadly as legally possible in whatever form it may be utilized.

The invention described herein is new and novel in accordance with 35 U.S.C. § 102 and satisfies the conditions for patentability in § 102. The invention described herein is not obvious in accordance with 35 U.S.C. § 103 and satisfies the conditions for patentability in § 103. The inventors may rely on the Doctrine of Equivalents to determine and assess the scope of the invention.

All patents and applications identified herein are incorporated fully herein for all purposes.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

What is claimed is each and every invention disclosed herein and:

1. A method for treating a stream, the stream including liquid, and the stream flowable, the stream having material therein, the material comprising first material and second material, the first material comprising particles of a first size with a first largest dimension, and the second material comprising particles of a second size with a second largest dimension, the first largest dimension being smaller than the second largest dimension, the method comprising flowing the stream to a system, the system Including a tube, the tube having an interior surface, the tube having a first end and a second end, the tube inclined with the first end higher than the second end so that the stream is flowable through the tube from the first end to the second end and out from the second end aided by gravity, jetting water into the stream within the tube, the jetted water moving the stream around within the tube to facilitate working of the materials of the stream within the tube, and inhibiting with the jetting water the stream from flowing downwards due to gravity, said inhibiting maintaining the stream within the tube for a period of time to prolong working of the material within the tube; wherein the system further comprises a top plurality of water inlets on top of the tube and a bottom plurality of water inlets on the bottom of the tube, the top plurality of water inlets opposed to the bottom plurality of water inlets, the method further comprising jetting water through the top plurality of water inlets, and simultaneously jetting water through the bottom plurality of water inlets to enhance the working of the material within the tube, and wherein the system includes a screening apparatus for screening material.

2. The method of claim 1 wherein the material comprises sand, the first material comprises sand, and the second material comprises sand.

3. The method of claim 1 wherein a liner comprises an inlet liner and an outlet liner, at least a portion of the interior surface of the tube is lined with the inlet liner and the outlet portion is lined with the outlet liner, the method further comprising flowing the material to contact the liner to enhance working of the material.

4. The method of claim 1 wherein the system includes a screening apparatus for screening material in the stream flowing out from the tube, the second material unable to pass through the screening apparatus and the first material able to pass through the screening apparatus, the method further comprising flowing the stream from the tube to the screening apparatus, and separating, with the screening apparatus, the first material from the second material.

5. The method of claim 4 wherein the screening apparatus comprises a screen, the screen having a top higher than a bottom thereof and curved inwardly from top to bottom with a curved surface down which the stream is flowable, the method further comprising flowing the stream to the top of the screen then down the screen to facilitate separation of the first material from the second material.

6. The method of claim 5 wherein the screen has screening material on a base, the base has a plurality of spaced-apart holes though which are passable the first material separated out from the stream by the screen, the holes disposed substantially vertically, the method further comprising flowing first material through the holes and down from the screen.

7. The method of claim 6 wherein the screen has a top screening material surface and each hole has an opening at said top screening material surface, each opening comprising an elongated opening with a length larger than a width thereof and a top end spaced-apart from a bottom end by said length, each said opening in fluid communication with a corresponding hole, said elongated openings configured to facilitate passage through the screen of first material, the method further comprising flowing the stream down the curved surface of the screen to the openings.

8. The method of claim 5 wherein the system further comprises water application apparatus for applying water on the screen, the method further comprising applying water on the screen into material flowing down the screen, the application of the water inhibiting downwardly flow of material down the screen and prolonging the material on the screen for a period of time.

9. The method of claim 4 wherein the screening apparatus comprises a first box above a second box, the second box disposed for receiving first material flowing from the first box, the first box comprising at least one inwardly curved first screen having a top higher than a bottom thereof and curved inwardly from top to bottom with a curved surface down which the stream is flowable, the method further comprising flowing the stream to the first box and to the top of the first screen to separate the first material from the second material, and producing an intermediate stream with first material and liquid, the second box comprising at least one inwardly curved second screen having a top higher than a bottom thereof and curved inwardly from top to bottom with a curved surface down which the stream is flowable, the method further comprising flowing the Intermediate stream from the first box to the second box and to the top of the second screen to separate out the first material, separated out first material flowing down from the second box.

* * * * *